US008057258B2

(12) United States Patent
Kawaguchi et al.

(10) Patent No.: US 8,057,258 B2
(45) Date of Patent: Nov. 15, 2011

(54) SHIELDED CONNECTOR

(75) Inventors: Daichi Kawaguchi, Yokkaichi (JP); Yukou Sato, Yokkaichi (JP); Toshio Kometani, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/926,738

(22) Filed: Dec. 7, 2010

(65) Prior Publication Data

US 2011/0081803 A1 Apr. 7, 2011

Related U.S. Application Data

(62) Division of application No. 12/452,945, filed as application No. PCT/JP2008/063733 on Jul. 31, 2008, now Pat. No. 7,909,647.

(30) Foreign Application Priority Data

Aug. 1, 2007 (JP) ..... 2007-200387

(51) Int. Cl.
*H01R 9/05* (2006.01)

(52) U.S. Cl. ..... 439/585; 439/607.48

(58) Field of Classification Search ..... 439/607.03, 439/578–580, 584, 585, 884, 866, 852, 851, 439/607.41, 607.48, 607.5, 607.51, 607.52
See application file for complete search history.

(56) References Cited

U.S. PATENT DOCUMENTS 6,786,781 B2 9/2004 Sai et al.
6,814,615 B2 * 11/2004 Laub et al. ..... 439/585

FOREIGN PATENT DOCUMENTS

| | | |
|---|---|---|
| JP | A-7-18379 | 1/1995 |
| JP | A-10-270123 | 10/1998 |
| JP | A-2006-244815 | 9/2006 |
| JP | A-2006-302824 | 11/2006 |

OTHER PUBLICATIONS

International Search Report for International Application No. PCT/JP2008/063733, issued Aug. 26, 2008.

* cited by examiner

*Primary Examiner* — Javaid Nasri
(74) *Attorney, Agent, or Firm* — Oliff & Berridge, PLC

(57) ABSTRACT

A shielded connector achieving sufficient contact load between a shielded conductor and a crimp portion of an outer conductor shell without influence such as deformation of cross sections on signal wires when the crimp portion is crimped onto the conductor, and enhanced pull-out strength of a shielded cable against the shell. The shell includes a tubular connection portion having an arc-shaped cross section and arranged to be inserted into the conductor end portion exposed by stripping off a sheath portion at the cable end portion, shielded conductor crimping portions opposed to the connection portion and arranged to be crimped onto the conductor end portion into which the connection portion has been inserted, and fitting spaces provided to an inside of the conductor crimping portions at positions opposed to the tubular connection portion. Upper ends of the connection portion and the conductor are inserted into the spaces during crimping process.

6 Claims, 11 Drawing Sheets

SHIELDED CONNECTOR

This is a Division of application Ser. No. 12/452,945 filed Jan. 29, 2010, now U.S. Pat. No. 7,909,647, which is a National Phase of PCT/JP2008/063733, filed Jul. 31, 2008. The disclosure of the prior applications is hereby incorporated by reference herein in its entirety.

TECHNICAL FIELD

The present invention relates to a wiring harness of an automobile and more particularly to a shielded connector to be connected to a shielded cable such as a shielded twisted-pair wire and a coaxial cable which are transmission cables for use in a LAN system mounted on a vehicle.

BACKGROUND ART

Generally, a shielded twisted-pair wire called STP has a shielded conductor in which a twisted wire of two signal wires is used. It is characterized in that the two signal wires are arranged to be adjacent to each other by being twisted so that a loop is formed at which a magnetic field of opposite polarities is generated and the thus-generated polarities are cancelled with each other, whereby an influence of electromagnetic induction can be reduced. It is known that if the wire is covered with a shielded conductor, the wire radiates less electromagnetic induction noise to the outside and receives less noise from the outside, and therefore, the wire is widely used as a LAN cable for high-speed transmission.

This kind of shielded twisted-pair wire is usually subjected to terminal processing and is connected to a dedicated connector called a modular connector. In recent years, there is a case in which a vehicle-mounted network of an electronic appliance such as a vehicle-mounted car navigation system is provided by using this kind of shielded twisted-pair wire.

An example of a shield connection between a shielded conductor of the shielded twisted-pair wire and an outer conductor shell of a shielded connector usually used in an automobile or others is disclosed in Japanese Utility Model Application Laid-open Publication No. Hei07-018379.

DISCLOSURE OF THE INVENTION

Problem to be Solved by the Invention

In the shielded connection disclosed in Japanese Utility Model Application Laid-open Publication No. Hei07-018379, a crimp portion provided to the outer conductor shell is crimped onto the shielded conductor which is exposed by stripping off a portion of a sheath. However, if the crimping process is performed with high pressure, twisted signal wires in the shielded conductor become flat, which leads to deterioration in high frequency characteristics. For this reason, pressure applied during the crimping process should be low, which results in low pull-out strength of the wire against the connector and a failure to achieve sufficient contact load to satisfy connection reliability for the wire to be used in a vibrating automotive vehicle.

An object of the present invention is to overcome the problems described above and to provide a shielded connector which can achieve sufficient contact load between a shielded conductor and a crimp portion of an outer conductor shell without having an influence such as deformation of cross sections on signal wires when the crimp portion of the outer conductor shell is crimped onto the shielded conductor, and achieve enhanced pull-out strength of a shielded cable against the outer conductor shell.

Means for Solving Problem

To achieve the objects and in accordance with the purpose of the present invention, a shielded connector to be connected to an end portion of a shielded cable having a signal wire, a shielded conductor arranged to cover the signal wire, and a sheath arranged to cover the shielded conductor includes an outer conductor shell including a tubular connection portion having an arc shape in cross section and arranged to be inserted into an end portion of the shielded conductor which is exposed by stripping off a portion of the sheath at the end portion of the shielded cable and into an end portion of the sheath, a pair of shielded conductor crimping portions opposed to the tubular connection portion and arranged to be crimped onto the end portion of the shielded conductor into which the tubular connection portion has been inserted, and a pair of sheath crimping portions opposed to the tubular connection portion and arranged to be crimped onto the end portion of the sheath into which the tubular connection portion has been inserted, wherein the tubular connection portion and the shielded conductor crimping portions together have a substantially perfect circle shape in cross section after the crimping process.

It is preferable that the tubular connection portion has an arc angle of 180 degrees or more in cross section before the crimping process. Further, it is preferable that fitting spaces are provided to an inside of the shielded conductor crimping portions at positions opposed to the tubular connection portion, and upper ends of the tubular connection portion and the shielded conductor are inserted into the fitting spaces during the crimping process. Still further, it is preferable that the fitting spaces are provided by forming a concave portion that extends inward and is defined by a portion of the shielded conductor crimping portions.

Additionally, it is preferable that a fitting hole is provided to a bottom wall of the tubular connection portion, and lower ends of the shielded conductor crimping portions and the shielded conductor are inserted into the fitting hole provided to the bottom wall of the tubular connection portion, which prevents lifting caused by spring-back of the shielded conductor crimping portions after the crimping process. Still additionally, it is preferable that projection portions are provided to the lower ends of the shielded conductor crimping portions, and the projection portions and the shielded conductor are inserted into the fitting hole provided to the bottom wall of the tubular connection portion while tips of the projection portions come into contact with each other to bend the projection portions during the crimping process. Yet additionally, it is preferable that a fitting hole is provided to the bottom wall of the tubular connection portion, and lower ends of the sheath crimping portions and the shielded conductor are inserted into the fitting hole while the sheath crimping portions are bent to break through the sheath, which prevents lifting caused by spring-back of the sheath crimping portions after the crimping process.

A shielded connector according to another preferred embodiment of the present invention to be connected to an end portion of a shielded cable having a signal wire, a shielded conductor arranged to cover the signal wire, and a sheath arranged to cover the shielded conductor includes an outer conductor terminal including a tubular connection portion having an arc shape in cross section and arranged to be inserted into an end portion of the shielded conductor which is exposed by stripping off a portion of the sheath at the end portion of the shielded cable and into an end portion of the sheath, a pair of shielded conductor crimping portions opposed to the tubular connection portion and arranged to be crimped onto the end portion of the shielded conductor into which the tubular connection portion has been inserted, and a pair of sheath crimping portions opposed to the tubular connection portion and arranged to be crimped onto the end portion of the sheath into which the tubular connection portion has been inserted, wherein the tubular connection portion and the shielded conductor crimping portions together have a substantially perfect circle shape in cross section after the crimping process.

It is preferable that an outer diameter of a portion of the tubular connection portion onto which the shielded conductor crimping portions are crimped and an outer diameter of a portion of the tubular connection portion onto which the sheath crimping portions are crimped are made substantially equal to an inner diameter of the shielded conductor. Further, it is preferable that a projection portion is provided to a top wall of the tubular connection portion at a position opposed to the shielded conductor crimping portions, a fitting hole is provided to a top wall of the shielded conductor crimping portions opposed to the projection portion, and the projection portion of the tubular connection portion and the shielded conductor are inserted into the fitting hole of the shielded conductor crimping portions during the crimping process.

Additionally, it is preferable that a fitting hole is provided to the bottom wall of the tubular connection portion, and the lower ends of the shielded conductor crimping portions and the shielded conductor are inserted into the fitting hole, which prevents lifting caused by spring-back of the shielded conductor crimping portions after the crimping process. Still additionally, it is preferable that projection portions are provided to the lower ends of the shielded conductor crimping portions, and the projection portions and the shielded conductor are inserted into the fitting hole provided to the bottom wall of the tubular connection portion while tips of the projection portions come into contact with each other to bend the projection portions during the crimping process. Yet additionally, it is preferable that a fitting hole is provided to the bottom wall of the tubular connection portion, and the projection portions of the sheath crimping portions and the shielded conductor are inserted into the fitting hole provided to the bottom wall of the tubular connection portion while the projection portions are bent to break through the sheath, which prevents lifting caused by spring-back of the sheath crimping portions after the crimping process.

Effect of the Invention

The shielded connector according to the present invention has the configuration in which the outer conductor shell includes the tubular connection portion having an arc shape in cross section and arranged to be inserted into the end portion of the shielded conductor which is exposed by stripping off the portion of the sheath at the end portion of the shielded cable and into the end portion of the sheath, the shielded conductor crimping portions arranged to be crimped onto the end portion of the shielded conductor into which the tubular connection portion has been inserted, and the sheath crimping portions arranged to be crimped onto the end portion of the sheath into which the tubular connection portion has been inserted, wherein the tubular connection portion and the shielded conductor crimping portions together have a substantially perfect circle shape in cross section after the crimping process. Accordingly, the shielded conductor crimping portions can exert compression force in normal direction to the outer surface of the tubular connection portion on the shielded conductor located on the tubular connection portion without having an influence such as deformation of cross sections on the signal wires in the shielded conductor, whereby enhanced connection reliability among the tubular connection portion, the shielded conductor and the shielded conductor crimping portions is achieved. Further, the sheath crimping portions to be crimped onto the end portion of the sheath into which the tubular connection portion has been inserted are opposed to the tubular connection portion. Accordingly, the sheath crimping portions can exert compression force in normal direction to the outer surface of the tubular connection portion on the sheath located on the tubular connection portion, whereby improved connection reliability against bending stress of the shielded cable as well as enhanced pull-out strength of the shielded cable are achieved. In addition, the tubular connection portion has an arc shape, i.e., an arch shape in cross section. Accordingly, uniform compression stress is developed in the cross section, whereby the tubular connection portion is not bent in its middle portion and shows high mechanical strength after being deformed by the crimping process. In addition, the outer conductor shell having the configuration described above is comprised of two members, one having the tubular connection portion and the other having the shielded conductor crimping portions and the sheath crimping portions. Accordingly, the number of members comprising the outer conductor shell can be minimized.

In this case, owing to the tubular connection portion having an arc angle of 180 degrees or more in cross section before the crimping process, the tubular connection portion is deformed during the crimping process and becomes to have a substantially perfect circle shape in cross section after the crimping process, whereby the possibility that the signal wires located in the tubular connection portion may be influenced by deformation of cross sections is eliminated. In addition, owing to the tubular connection portion having an arc angle of 180 degrees or more in cross section before the crimping process, uniform compression stress is developed in the cross section during the crimping process, whereby the tubular connection portion is not bent in its middle portion. In addition, because the fitting spaces are provided to the inside of the shielded conductor crimping portions at the positions opposed to the tubular connection portion and the upper ends of the tubular connection portion and the shielded conductor are inserted into the fitting spaces during the crimping process, the shielded conductor crimping portions can further exert compression force in tangential direction to the outer surface of the tubular connection portion on the shielded conductor located on the tubular connection portion, whereby enhanced pull-out strength of the shielded conductor as well as improved connection reliability among the tubular connection portion, the shielded conductor and the shielded conductor crimping portions are achieved.

Further, because the fitting spaces of the shielded conductor crimping portions are provided by forming the concave portion that extends inward and is defined by the portion of the shielded conductor crimping portions, the fitting spaces can be provided to the inside of the shielded conductor crimping portions with a simple manner. In addition, the concave portion is also brought into contact with the shielded conductor, whereby enhanced pull-out strength of the shielded conductor as well as improved connection reliability are achieved.

In this case, because the fitting hole is provided to the bottom wall of the tubular connection portion and the lower ends of the shielded conductor crimping portions and the shielded conductor are inserted into the fitting hole, which prevents lifting caused by spring-back of the shielded conductor crimping portions after the crimping process, the shielded conductor crimping portions can further exert compression force in tangential direction to the outer surface of the tubular connection portion on the shielded conductor located on the tubular connection portion, whereby enhanced pull-out strength of the shielded conductor as well as improved connection reliability among the tubular connection portion, the shielded conductor and the shielded conductor crimping portions are achieved. In addition, this arrangement also prevents lifting caused by spring-back of the shielded conductor crimping portions after the crimping process. Further, because the projection portions are provided to the lower ends of the shielded conductor crimping portions and the projection portions and the shielded conductor are inserted into the fitting hole provided to the bottom wall of the tubular connection portion while the tips of the projection portions come into contact with each other to bend the projection portions during the crimping process, the shielded conductor can be smoothly guided into the fitting hole and the tips of the projection portions can hold the shielded conductor at the fitting hole without fail, whereby the shielded conductor at the fitting hole can be held without fail.

Further, because the fitting hole is provided to the bottom wall of the tubular connection portion, and the lower ends of the sheath crimping portions and the shielded conductor are inserted into the fitting hole while the sheath crimping portions are bent to break through the sheath, which prevents lifting caused by spring-back of the sheath crimping portions after the crimping process, the sheath crimping portions can further exert compression force in tangential direction to the outer surface of the tubular connection portion on the shielded conductor and the sheath that are located on the tubular connection portion, whereby connection of the tubular connection portion, the shielded conductor and the sheath crimping portions is achieved. In addition, enhanced pull-out strength of the shielded cable and improved connection reliability against bending stress of the shielded cable are achieved. This arrangement also prevents lifting caused by spring-back of the sheath crimping portions after the crimping process.

The shielded connector according to another preferred embodiment of the present invention having the configuration described above includes the outer conductor terminal including the tubular connection portion having an arc shape in cross section and arranged to be inserted into the end portion of the shielded conductor which is exposed by stripping off the portion of the sheath at the end portion of the shielded cable and into the end portion of the sheath, the shielded conductor crimping portions opposed to the tubular connection portion and arranged to be crimped onto the end portion of the shielded conductor into which the tubular connection portion has been inserted, and the sheath crimping portions opposed to the tubular connection portion and arranged to be crimped onto the end portion of the sheath into which the tubular connection portion has been inserted, wherein the tubular connection portion and the shielded conductor crimping portions together have a substantially perfect circle shape in cross section after the crimping process. Accordingly, the shielded conductor crimping portions can exert compression force in normal direction to the outer surface of the tubular connection portion on the shielded conductor located on the tubular connection portion without having an influence such as deformation of cross sections on the signal wires in the shielded conductor, whereby improved connection reliability among the tubular connection portion, the shielded conductor and the shielded conductor crimping portions is achieved. In addition, the sheath crimping portions to be crimped onto the end portion of the sheath into which the tubular connection portion has been inserted are opposed to the tubular connection portion. Accordingly, the sheath crimping portions can exert compression force in normal direction to the outer surface of the tubular connection portion on the sheath located on the tubular connection portion, whereby improved connection reliability against bending stress of the shielded cable as well as enhanced pull-out strength of the shielded cable are achieved. In addition, the tubular connection portion has a circle shape in cross section. Accordingly, uniform compression stress is developed in the cross section, whereby the tubular connection portion is not bent in its middle portion and shows high mechanical strength after being deformed by the crimping process. In addition, the outer conductor shell having the configuration described above is comprised of two members, one having the tubular connection portion and the other having the shielded conductor crimping portions and the sheath crimping portions. Accordingly, the number of members comprising the outer conductor shell can be minimized.

Because the outer diameter of the portion of the tubular connection portion onto which the shielded conductor crimping portions are crimped and the outer diameter of the portion of the tubular connection portion onto which the sheath crimping portions are crimped are made substantially equal to an inner diameter of the shielded conductor, if the shielded conductor consists of a braided wire of a plurality of elemental wires, the shielded conductor consisting of the braided wire is not necessary to be enlarged for receiving therein the tubular connection portion, whereby the tubular connection portion can be easily inserted into the shielded conductor. If the inner diameter of the shielded conductor consisting of the braided wire is enlarged, picks of the elemental wires are frayed. However, because the outer diameter of the tubular connection portion having a circle shape in cross section is made substantially equal to the inner diameter of the shielded conductor consisting of a braided wire, picks of the elemental wires are not frayed. Accordingly, the shielded conductor crimping portions can be crimped uniformly onto the shielded conductor, whereby enhanced pull-out strength of the shielded conductor as well as improved connection reliability among the tubular connection portion, the shielded conductor and the shielded conductor crimping portions are achieved. In addition, because the projection portion is provided to the top wall of the tubular connection portion at the position opposed to the shielded conductor crimping portions, the fitting hole is provided to the shielded conductor crimping portions opposed to the projection portion, and the projection portion and the shielded conductor are inserted into the fitting hole during the crimping process, enhanced pull-out strength of the shielded conductor as well as improved connection reliability among the tubular connection portion, the shielded conductor and the shielded conductor crimping portions are achieved.

Further, because the fitting hole is provided to the bottom wall of the tubular connection portion, and the lower ends of the shielded conductor crimping portions and the shielded conductor are inserted into the fitting hole, which prevents lifting caused by spring-back of the shielded conductor crimping portions after the crimping process, the shielded conductor crimping portions can further exert compression force in tangential direction to the shielded conductor on the tubular connection portion, whereby enhanced pull-out strength of the shielded conductor as well as improved connection reliability of the tubular connection portion, the shielded conductor and the shielded conductor crimping portions are achieved. This arrangement also prevents lifting caused by spring-back of the shielded conductor crimping portions after the crimping process. Further, because the projection portions are each provided to the lower ends of the shielded conductor crimping portions, and the projection portions and the shielded conductor are inserted into the fitting hole provided to the bottom wall of the tubular connection portion while the tips of the projection portions come into contact with each other to bend the projection portions during the crimping process, the shielded conductor can be smoothly guided into the fitting hole and the tips of the projection portions can hold the shielded conductor at the fitting hole without fail, whereby the shielded conductor at the fitting hole can be held without fail.

Still further, if the fitting hole is provided to the bottom wall of the tubular connection portion, and the lower ends of the sheath crimping portions and the shielded conductor are inserted into the fitting hole while the sheath crimping portions are bent to break through the sheath, which prevents lifting caused by spring-back of the sheath crimping portions after the crimping process, the sheath crimping portions can further exert compression force in tangential direction on the shielded conductor and the sheath that are located on the tubular connection portion, whereby the sheath crimping portions and the shielded conductor are brought into contact with each other. In addition, improved connection reliability against bending stress of the shielded cable as well as enhanced pull-out strength of the shielded cable are achieved. This arrangement also prevents lifting caused by spring-back of the sheath crimping portions after the crimping process.

BEST MODE FOR CARRYING OUT THE INVENTION

A detailed description of preferred embodiments of a shielded connector according to the present invention will be given with reference to the accompanying drawings. The shielded connector according to the preferred embodiments of the present invention is used for a multi-contact shielded cable having a plurality of signal wires and is especially used for a shielded twisted-pair wire having six signal wires.

Figure 1:
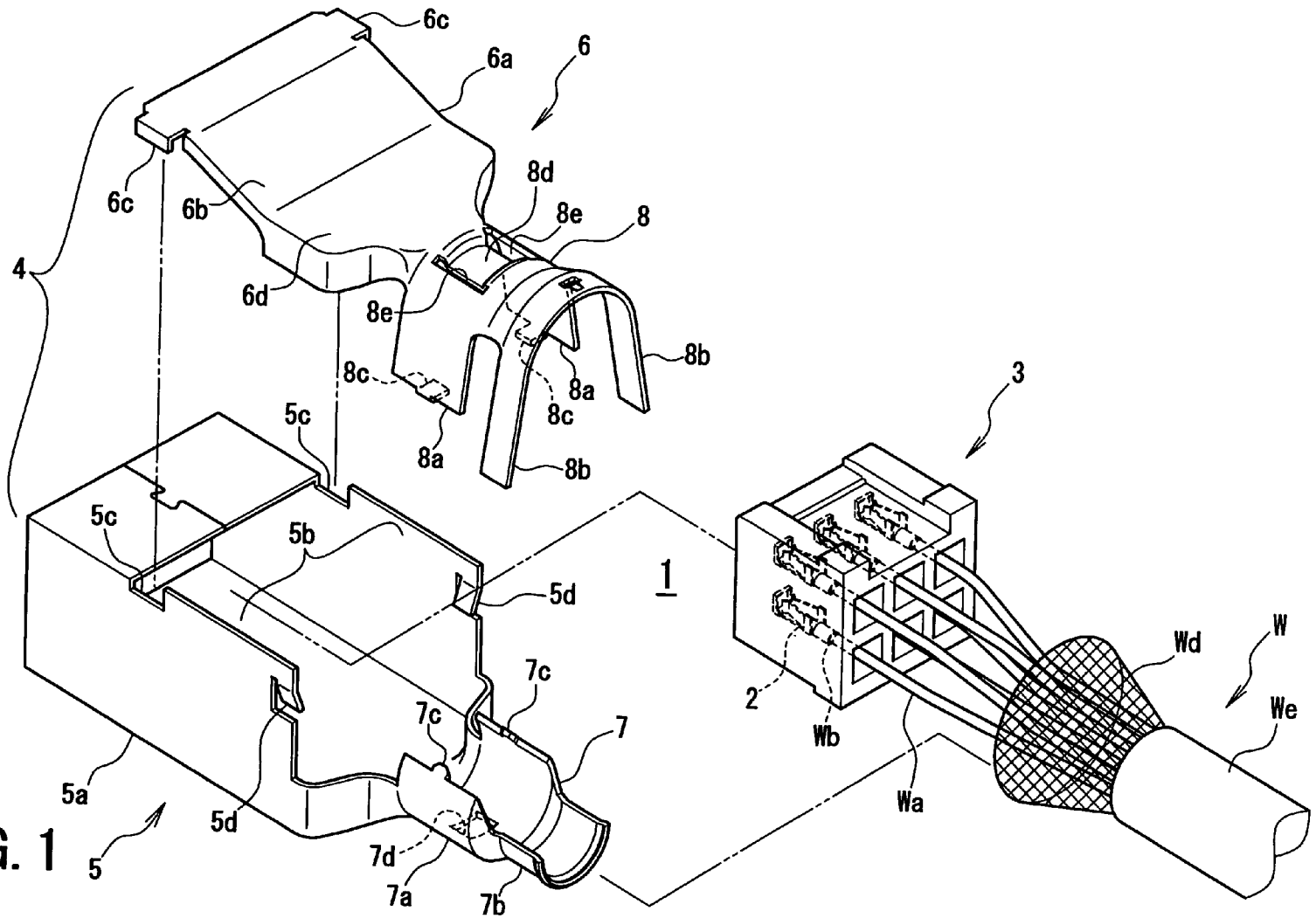
FIG. 1 is an exploded perspective view showing a shielded connector 1 according to a first preferred embodiment of the present invention.
Figure 2:
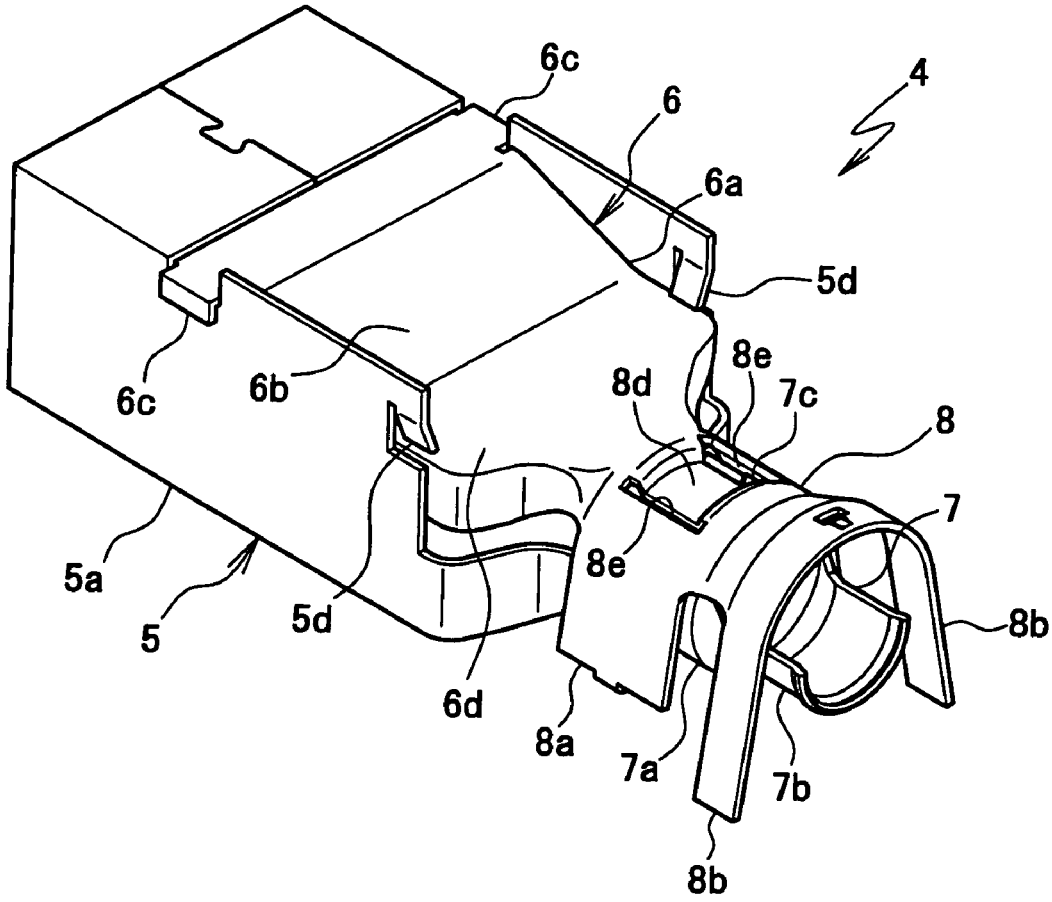
FIG. 2 is an external perspective view showing an assembled state of an outer conductor shell 4 comprised of two members.
Figure 3:
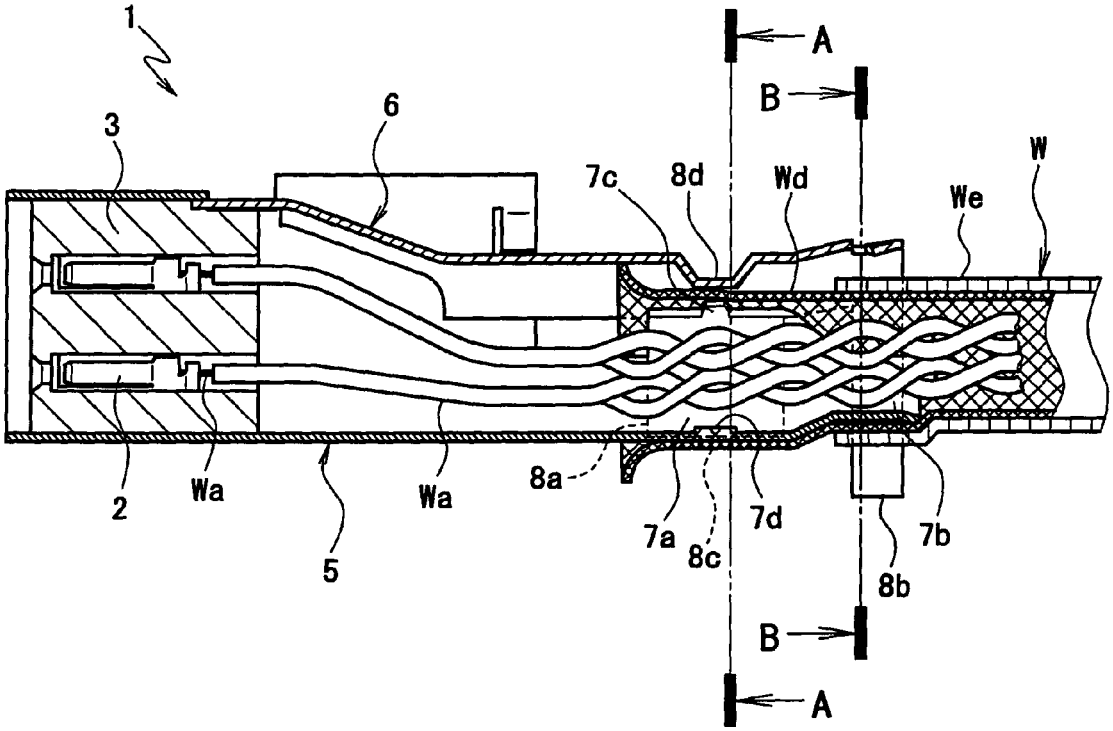
FIG. 3 is a view showing a section of the shielded connector 1 before a crimping process.
Figure 4A:
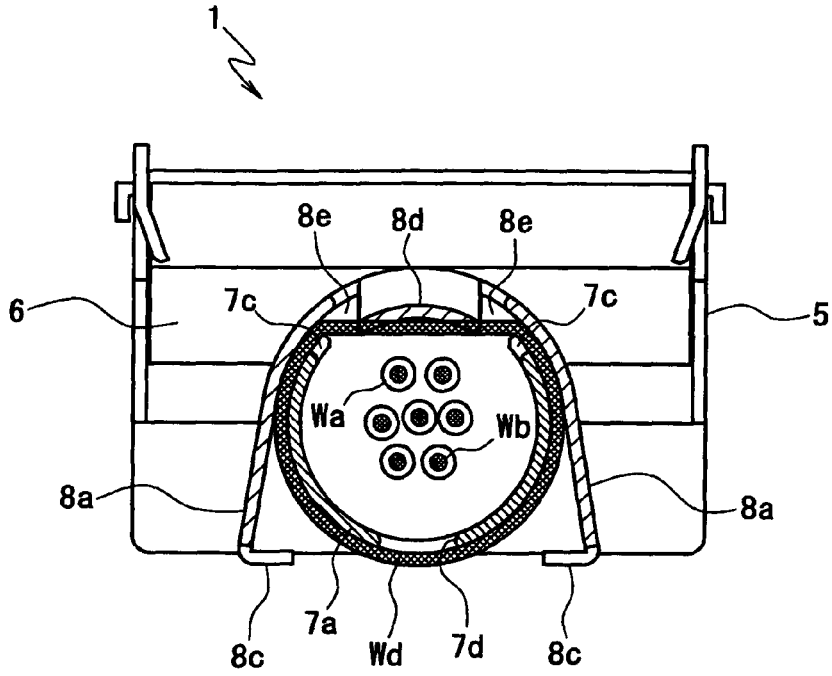
FIG. 4A is a view showing an A-A section in FIG. 3.
Figure 4B:
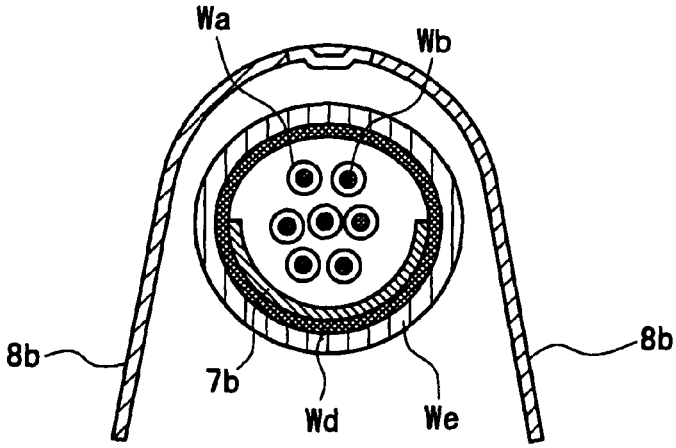
FIG. 4B is a view showing a B-B section in FIG. 3.
Figure 5:
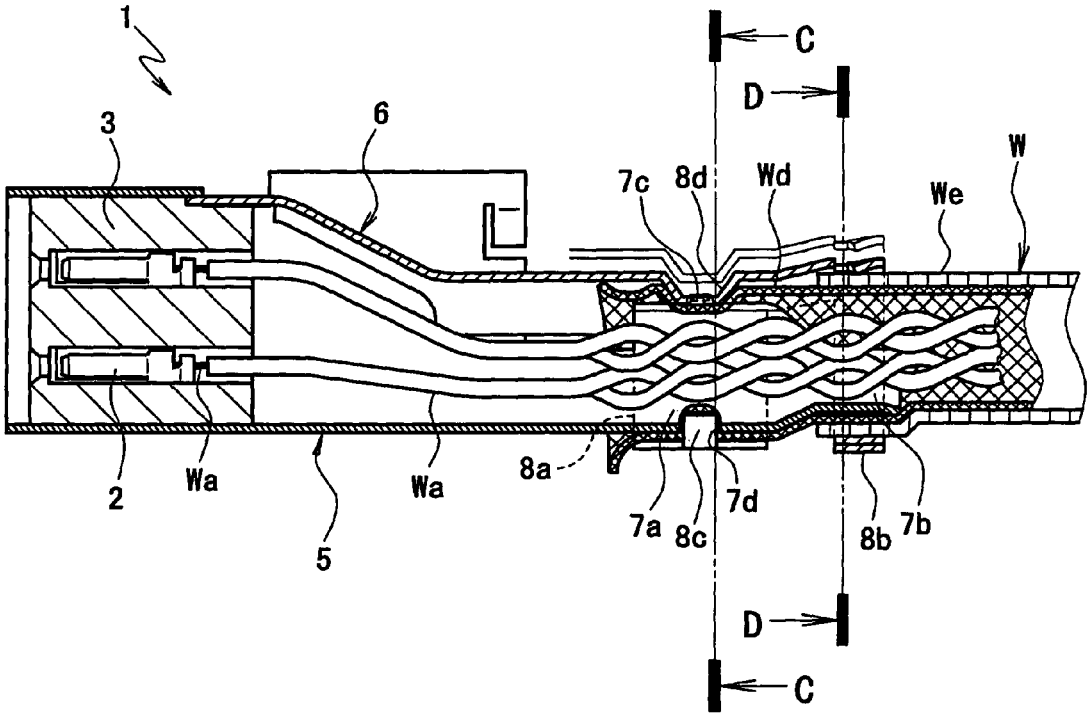
FIG. 5 is a view showing the section of the shielded connector 1 after the crimping process.
Figure 6A:
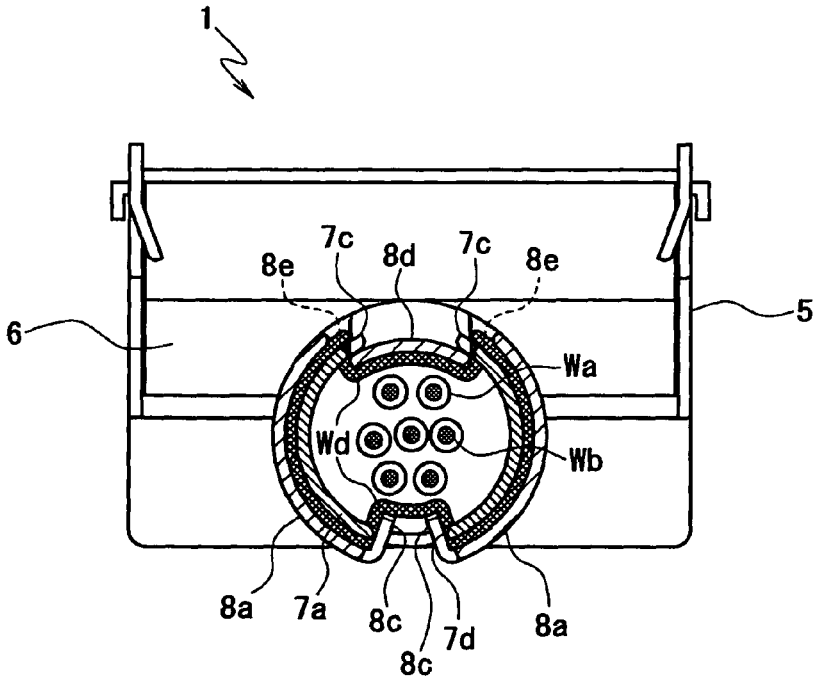
FIG. 6A is a view showing a C-C section in FIG. 5.
Figure 6B:
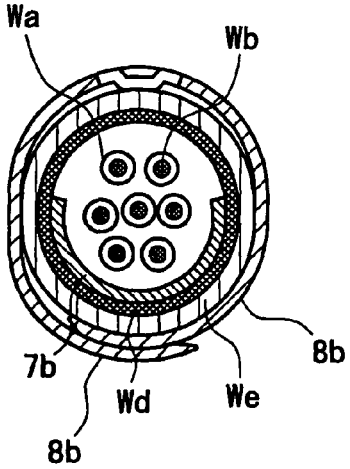
FIG. 6B is a view showing a D-D section in FIG. 5.

First, a description of a shielded connector 1 according to a first preferred embodiment of the present invention will be given with reference to FIGS. 1 to 6. FIG. 1 is an exploded perspective view showing the shielded connector 1 according to the first preferred embodiment of the present invention. FIG. 2 is an external perspective view showing an assembled state of an outer conductor shell 4 comprised of two members. FIG. 3 is a view showing a section of the shielded connector 1 before a crimping process. FIG. 4A is a view showing an A-A section in FIG. 3, and FIG. 4B is a view showing a B-B section in FIG. 3. FIG. 5 is a view showing the section of the shielded connector 1 after the crimping process. FIG. 6A is a view showing a C-C section in FIG. 5, and FIG. 6B is a view showing a D-D section in FIG. 5. In the following descriptions, the side of the shielded conductor to which a corresponding connector (not shown) is fitted is referred to as the front side.

As shown in FIG. 1, the shielded connector 1 to be connected to an end portion of a shielded twisted-pair wire W includes inner conductor terminals 2, an inner housing 3, and the outer conductor shell 4.

The inner conductor terminals 2 are connected to signal conductors Wb of signal wires Wa of the shielded twisted-pair wire W to transmit high-frequency signals and have a so-called female terminal shape. The inner housing 3 arranged to house the inner conductor terminals 2 provides an insulating state between the inner conductor terminals 2 and the outer conductor shell 4 and is made from a resin insulating member having a predetermined dielectric constant. The inner conductor terminals 2 are inserted into the inner housing 3 from the back side to be secured.

The outer conductor shell 4 is connected to a shielded conductor Wd of the shielded twisted-pair wire W and covers the inner conductor terminals 2 to electromagnetically shield the inner conductor terminals 2. The outer conductor shell includes an outer conductor case 5 and an outer conductor cover 6 arranged to be assembled with the outer conductor case 5.

The outer conductor case 5 has a substantially cylindrical shape and is prepared by bending a conductive plate material. A main portion 5*a* of the outer conductor case 5 is arranged to house the inner housing 3 inside. On the top of the main portion 5*a* on the back side, an opening portion 5*b* is provided in order to allow the inner housing 3 to be easily housed in the main portion 5*a*. On side walls of the opening portion 5*b* on the front side, concave portions 5*c*, 5*c* are provided with which bent portions 6*c*, 6*c* of the outer conductor cover 6 assembled as shown in FIG. 2 are to be engaged. Further, on the side walls of the opening portion 5*b* on the back side, engagement portions 5*d*, 5*d* are provided to project obliquely inward and are arranged to be engaged with the top surface of a flat portion 6*d* of the outer conductor cover 6 assembled as shown in FIG. 2 so as to prevent the outer conductor cover 6 from being easily disengaged from the outer conductor case 5.

On the back side of the main portion 5*a* of the outer conductor case 5, a tubular connection portion 7 that opens upward and has an arc shape in cross section is provided. As shown in FIG. 3, the tubular connection portion 7 is covered with the shielded conductor Wd onto which a pair of shielded conductor crimping portions 8*a*, 8*a* and a pair of sheath crimping portions 8*b*, 8*b* of the outer conductor cover 6 are crimped. The tubular connection portion 7 includes a large-diameter portion 7*a* onto which the shielded conductor crimping portions 8*a*, 8*a* are to be crimped and a small-diameter portion 7*b* onto which the sheath crimping portion 8*b*, 8*b* are to be crimped.

The large-diameter portion 7*a* of the tubular connection portion 7 preferably has an arc angle of 180 degrees or more in cross section, and in the first preferred embodiment, the arc angle is about 270 degrees as shown in FIG. 4A. Owing to the large-diameter portion 7*a* having an arch shape in cross section, uniform compression stress is developed in the cross section during the crimping process, whereby the large-diameter portion 7*a* is not bent in its middle portion and shows high mechanical strength after being deformed by the crimping process. At the centers of upper ends of the large-diameter portion 7*a*, projection portions 7*c*, 7*c* are provided to project obliquely, upwardly and inwardly. Fitting spaces 8*e*, 8*e* are provided to a crimp portion 8 of the outer conductor cover 6 as shown in FIG. 4A. The projection portions 7*c*, 7*c* and the shielded conductor Wd are inserted into the fitting spaces 8*e*, 8*e* during the crimping process (see FIG. 6A).

A fitting hole 7*d* is provided to a bottom wall of the large-diameter portion 7*a* to run through the bottom wall. Projection portions 8*c*, 8*c* are provided to the shielded conductor crimping portions 8*a*, 8*a* of the outer conductor cover 6 as shown in FIG. 4A, and the projection portions 8*c*, 8*c* and the shielded conductor Wd are inserted into the fitting hole 7*d* during the crimping process (see FIG. 6A). The shielded conductor Wd is fixed to the large-diameter portion 7*a* by the crimping of the shielded conductor crimping portions 8*a*, 8*a*.

The small-diameter portion 7*b* of the tubular connection portion 7 has an arc angle of about 180 degrees in cross section as shown in FIG. 4B. Owing to the small-diameter portion 7*b* having an arch shape in cross section, uniform compression stress is developed in the cross section during the crimping process, whereby the small-diameter portion 7*b* is not bent in its middle portion. As shown in FIG. 3, the small-diameter portion 7*b* is covered with the shielded conductor Wd and a sheath We. The shielded conductor Wd and the sheath We are fixed to the small-diameter portion 7*b* as shown in FIG. 4B by the crimping of the sheath crimping portions 8*b*, 8*b* of the outer conductor cover 6 (see FIG. 6B).

The outer conductor cover 6 has a roof shape and is formed by bending a conductive plate material in the same manner as the outer conductor case 5. The outer conductor cover 6 includes a cover portion 6*a* arranged to close the opening portion 5*b* of the outer conductor case 5 and the crimp portion 8 provided to the back side of the cover portion 6*a*. The opening portion 5*b* of the outer conductor case 5 is closed by the outer conductor cover 6, whereby deterioration of shielding performance is prevented.

The cover portion 6*a* has a slanted portion 6*b* which is slanted backward from a middle portion of the cover portion 6*a*. On the both sides of a portion on the front side of the slanted portion 6*b*, bent portions 6*c*, 6*c* that are bent downward are provided. The bent portions 6*c*, 6*c* are engaged with the concave portions 5*c*, 5*c* when the outer conductor cover 6 is fit to the opening portion 5*b* of the outer conductor case 5, whereby downward movement of the outer conductor cover 6 is prevented. Further, the top surface of the flat portion 6*d* on the back side of the slanted portion 6*b* is engaged with the engagement portions 5*d*, 5*d* when the outer conductor cover 6 is fit to the opening portion 5*b* of the outer conductor case 5 for preventing the outer conductor cover 6 from being easily disengaged from the outer conductor case 5.

On the back side of the cover portion 6*a* of the outer conductor cover 6, the crimp portion is provided. The crimp portion 8 includes the shielded conductor crimping portions 8*a*, 8*a* that open downward and the sheath crimping portions 8*b*, 8*b* that open downward.

The shielded conductor crimping portions 8*a*, 8*a* extend downward from a top wall of the crimp portion 8. At the centers of lower ends of the shielded conductor crimping portions 8*a*, 8*a*, projection portions 8*c*, 8*c* that extend inward are provided. The projection portions 8*c*, 8*c* and the shielded conductor Wd are inserted into the fitting hole 7*d* of the large-diameter portion 7*a* of the outer conductor cover 6 during the crimping process. The projection portions 8*c*, 8*c* of the shielded conductor crimping portions 8*a*, 8*a* extend inward in order to bring about a pushed-in state of the shielded conductor Wd as shown in FIG. 6A when the projection portions 8*c*, 8*c* and the shielded conductor Wd are inserted into the fitting hole 7*d* of the large-diameter portion 7*a*. Accordingly, the projection portions 8*c*, 8*c* allow the shielded conductor Wd to be smoothly pushed into the fitting hole 7*d* of the large-diameter portion 7*a*.

A concave portion 8*d* that extends inward is provided to the top wall of the crimp portion 8 at a position corresponding to the shielded conductor crimping portions 8*a*, 8*a*. Fitting spaces 8*e*, 8*e* are provided by forming the concave portion 8*d*, and the projection portions 7*c*, 7*c* of the large-diameter portion 7*a* of the tubular connection portion 7 and the shielded conductor Wd are inserted into the fitting spaces 8*e*, 8*e* during the crimping process.

The sheath crimping portions 8*b*, 8*b* extend downward from the top wall of the crimp portion 8. The shielded conductor Wd and the sheath We are fixed to the small-diameter portion 7*b* of the tubular connection portion 7 during the crimping process of the sheath crimping portions 8*b*, 8*b*. In this case, the crimping process is performed such that a portion of one of the sheath crimping portions 8*b*, 8*b* is placed on the other sheath crimping portion 8*b* as shown in FIG. 6B.

A process of connecting the shielded twisted-pair wire W to the shielded connector 1 having the configuration described above includes steps of 1) exposing the signal conductors Wb and the shielded conductor Wd over predetermined lengths by stripping off a portion of the shielded twisted-pair wire W; 2) crimping crimp portions of the inner conductor terminals 2 onto the signal conductors Wb; 3) inserting the inner conductor terminals 2 into the inner housing 3; 4) housing the inner housing 3 in the outer conductor case 5 while covering the tubular connection portion 7 with the shielded conductor Wd; and 5) fitting the outer conductor cover 6 in the opening portion 5*b* of the outer conductor case 5 and simultaneously crimping the crimp portion 8 of the outer conductor cover 6 and the tubular connection portion 7 onto the shielded conductor Wd and the sheath We.

The shielded connector 1 has the configuration in which the tubular connection portion 7 and the shielded conductor crimping portions 8*a*, 8*a* are provided to the outer conductor shell 4, the tubular connection portion 7 having an arc shape in cross section and arranged to be inserted into the shielded conductor Wd which is exposed by stripping off a portion of the sheath We at the end portion of the shielded twisted-pair wire W, while the shielded conductor crimping portions 8*a*, 8*a* opposed to the tubular connection portion 7 and arranged to be crimped onto the shielded conductor Wd in which the tubular connection portion has been inserted. Accordingly, the shielded conductor crimping portions 8*a*, 8*a* can exert compression force in normal direction on the shielded conductor Wd located on the tubular connection portion 7 without having an influence such as deformation of cross sections on the signal wires Wa in the tubular connection portion 7, whereby enhanced connection reliability between the shielded conductor Wd and the shielded conductor crimping portions 8*a*, 8*a* is achieved.

Further, the sheath crimping portions 8*b*, 8*b* to be crimped onto the end portion of the sheath We into which the tubular connection portion 7 has been inserted are provided to the outer conductor shell 4. Accordingly, the sheath crimping portions 8*b*, 8*b* can exert compression force in normal direction to the sheath We on the tubular connection portion 7, whereby enhanced pull-out strength as well as improved connection reliability against bending stress of the shielded twisted-pair wire W are achieved.

Still further, the outer conductor shell 4 is comprised of two members of the outer conductor case 5 to which the tubular connection portion 7 is provided and the outer conductor cover 6 to which the crimp portion 8 is provided. Accordingly, the outer conductor shell 4 can be comprised of a limited number of members.

In this case, owing to the large-diameter portion 7*a* of the tubular connection portion 7 having an arc angle of 180 degrees or more in cross section before the crimping process, the large-diameter portion 7*a* is deformed during the crimping process and becomes to have a substantially circle shape in cross section after the crimping process. Accordingly, the possibility that the signal wires Wa located in the tubular connection portion 7 may be influenced by deformation of cross sections is eliminated, and the shielded conductor crimping portions 8*a*, 8*a* can exert compression force in normal direction to an outer surface of the large-diameter portion 7*a* on the shielded conductor Wd located on the large-diameter portion 7*a* of the tubular connection portion 7, whereby enhanced connection reliability among the tubular connection portion 7, the shielded conductor Wd and the shielded conductor crimping portions 8*a*, 8*a* is achieved.

Yet further, the fitting spaces 8*e*, 8*e* are provided to the inside of the shielded conductor crimping portions 8*a*, 8*a* at the positions opposed to the tubular connection portion 7, and the projection portions 7*c*, 7*c* of the large-diameter portion 7*a* and the shielded conductor Wd are inserted into the fitting spaces 8*e*, 8*e* during the crimping process. Accordingly, the shielded conductor crimping portions 8*a*, 8*a* can further exert compression force in tangential direction to the outer surface of the large-diameter portion 7*a* on the shielded conductor Wd located on the large-diameter portion 7*a*, whereby enhanced pull-out strength of the shielded conductor Wd as well as improved connection reliability among the tubular connection portion 7, the shielded conductor Wd and the shielded conductor crimping portions 8*a*, 8*a* are achieved.

Additionally, the fitting spaces 8*e*, 8*e* of the shielded conductor crimping portions 8*a*, 8*a* are provided by forming the concave portion 8*d* that extends inward and is defined by a portion of the shielded conductor crimping portions 8*a*, 8*a*. Accordingly, the fitting spaces 8*e*, 8*e* can be provided to the inside of the shielded conductor crimping portions 8*a*, 8*a* with a simple manner. In addition, the concave portion 8*d* is brought into contact with the shielded conductor Wd, whereby enhanced pull-out strength of the shielded conductor Wd as well as improved connection reliability are achieved.

In this case, the fitting hole 7*d* is provided to the bottom wall of the large-diameter portion 7*a* of the tubular connection portion 7, and the projection portions 8*c*, 8*c* of the shielded conductor crimping portions 8*a*, 8*a* and the shielded conductor Wd are inserted into the fitting hole 7*d*. Accordingly, the shielded conductor crimping portions 8*a*, 8*a* can further exert compression force in tangential direction to the outer surface of the large-diameter portion 7*a* on the shielded conductor Wd located on the large-diameter portion 7*a* of the tubular connection portion 7, whereby enhanced pull-out strength of the shielded conductor Wd as well as improved connection reliability between the shielded conductor Wd and the shielded conductor crimping portions 8*a*, 8*a* are achieved. Further, this arrangement also prevents lifting caused spring-back of the shielded conductor crimping portions 8*a*, 8*a* after the crimping process.

Figure 7:
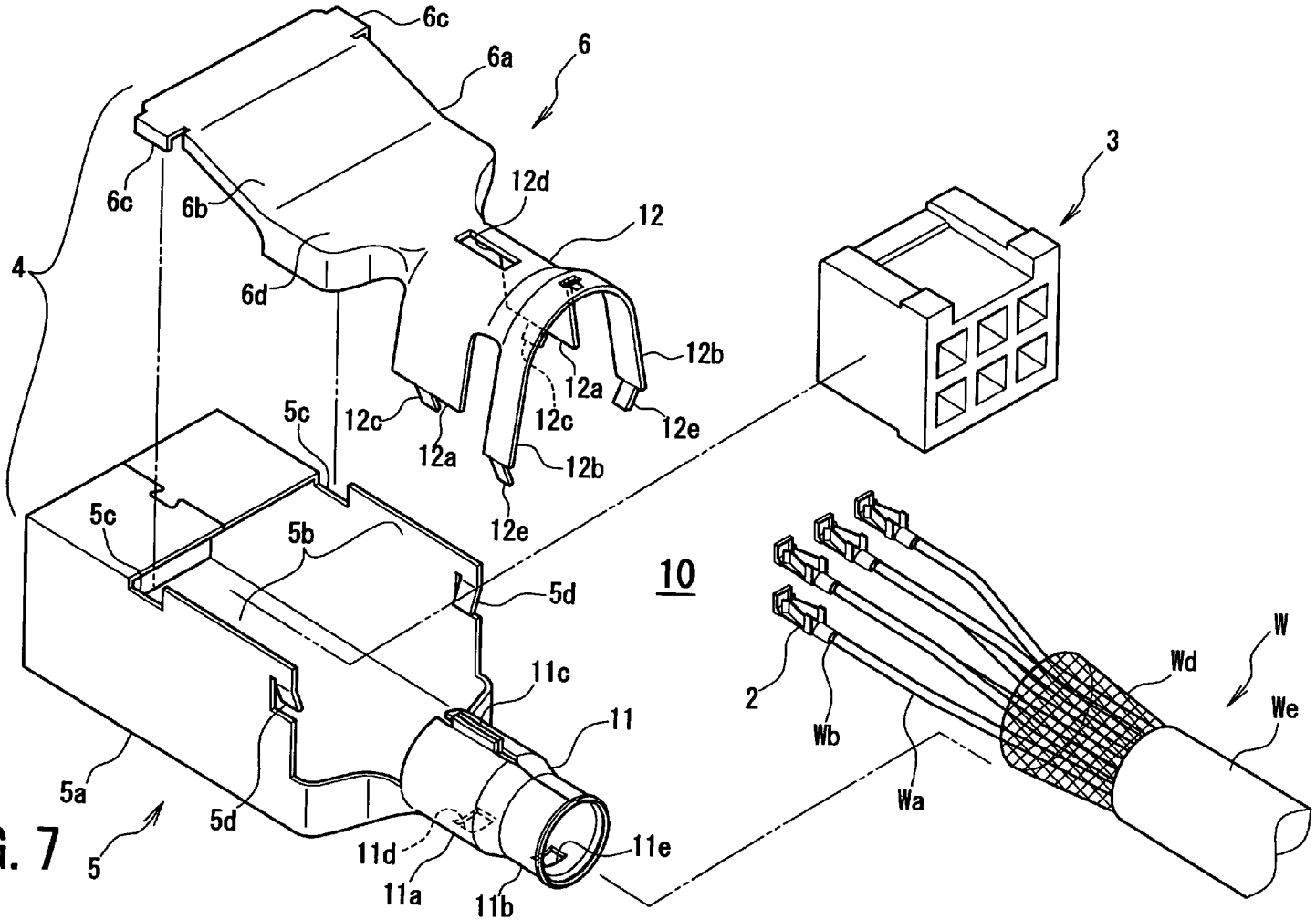
FIG. 7 is an exploded perspective view showing a shielded connector 10 according to a second preferred embodiment of the present invention.
Figure 8:
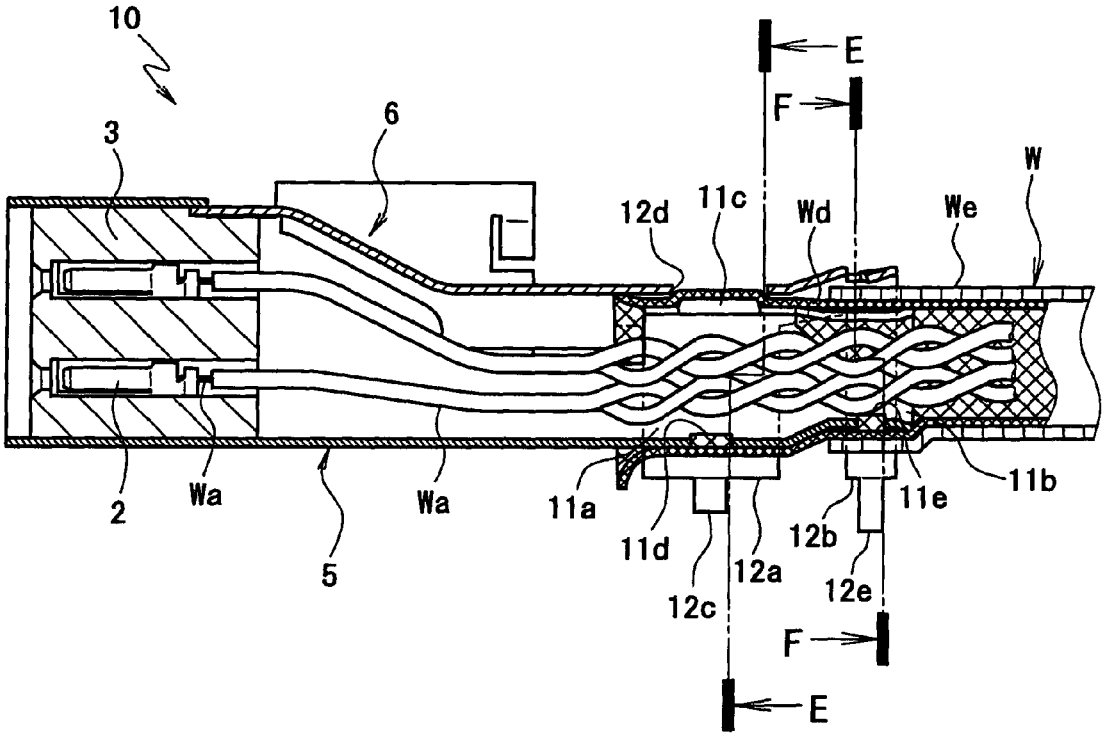
FIG. 8 is a view showing a section of the shielded connector 10 before a crimping process.
Figure 9A:
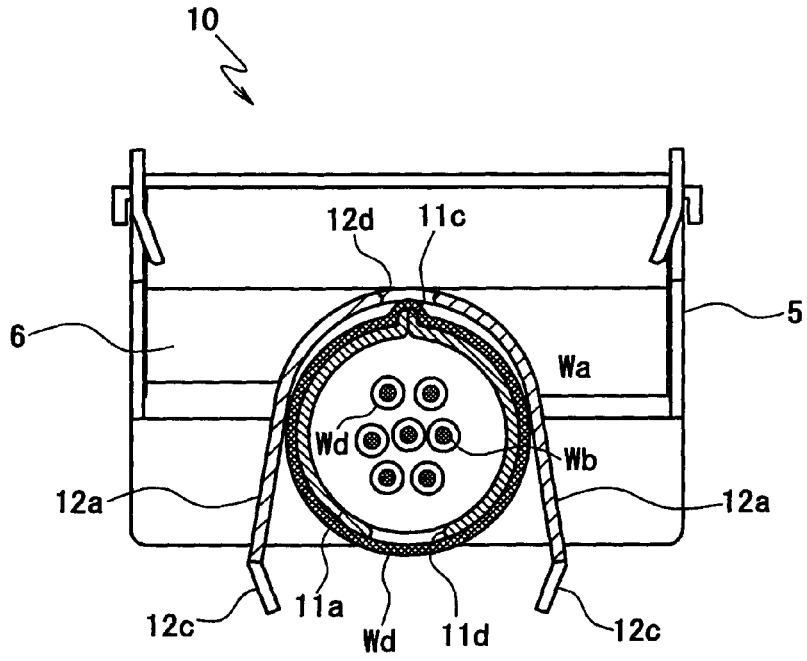
FIG. 9A is a view showing an E-E section in FIG. 8.
Figure 9B:
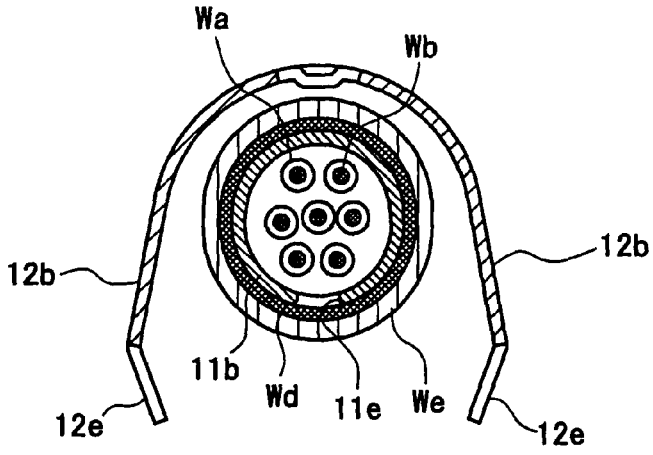
FIG. 9B is a view showing an F-F section in FIG. 8.
Figure 10:
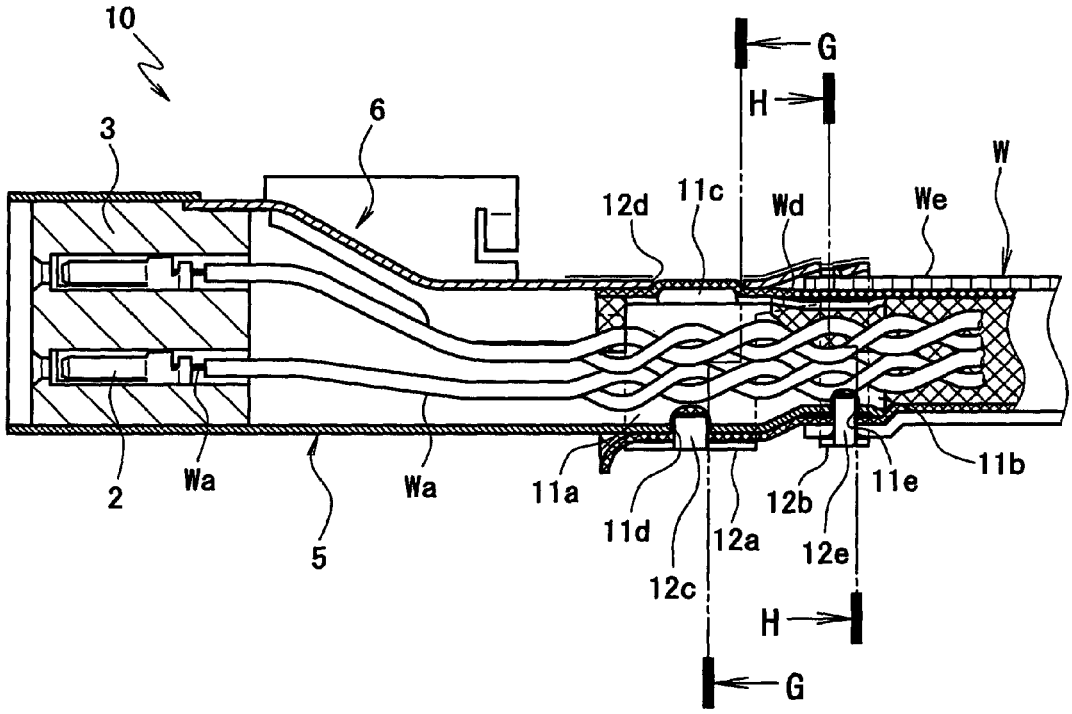
FIG. 10 is a view showing the section of the shielded connector 10 after the crimping process.
Figure 11A:
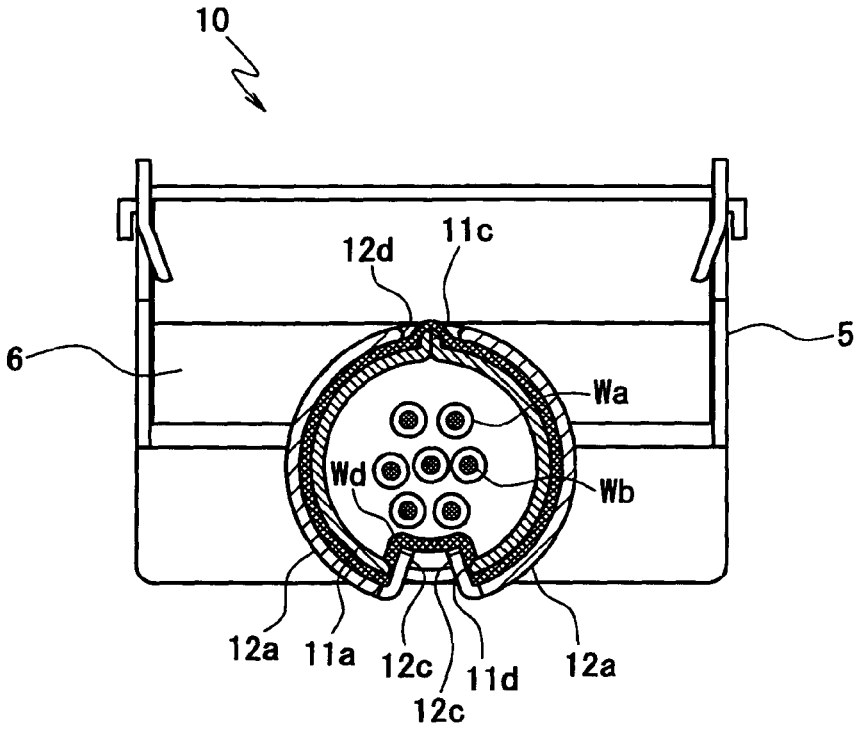
FIG. 11A is a view showing a G-G section in FIG. 10.
Figure 11B:
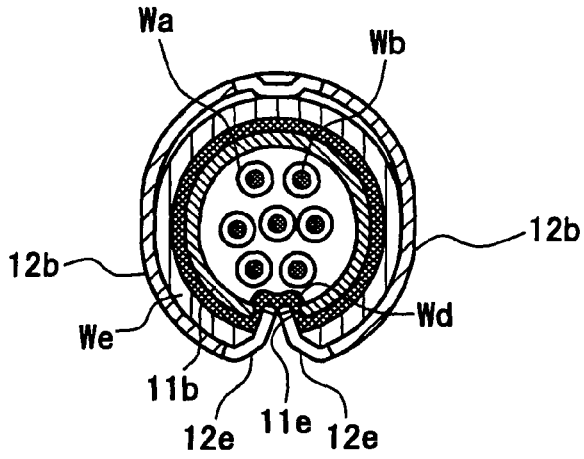
FIG. 11B is a view showing an H-H section in FIG. 10.

Next, a description of a shielded connector 10 according to a second preferred embodiment of the present invention will be given with reference to FIGS. 7 to 11. FIG. 7 is an exploded perspective view showing the shielded connector 10 according to the second preferred embodiment of the present invention. FIG. 8 is a view showing a section of the shielded connector 10 before a crimping process. FIG. 9A is a view showing an E-E section in FIG. 8, and FIG. 9B is a view showing an F-F section in FIG. 8. FIG. 10 is a view showing the section of the shielded connector 10 after the crimping process. FIG. 11A is a view showing a G-G section in FIG. 10, and FIG. 10B is a view showing an H-H section in FIG. 10.

The same elements as the shielded connector 1 according to the first preferred embodiment of the present invention are assigned the same reference numerals, descriptions thereof are omitted, and different respects are mainly described.

As shown in FIG. 7, a tubular connection portion 11 having a circle shape in cross section is provided to the back side of the main portion 5*a* of the outer conductor case 5 of the shielded connector 10. As shown in FIG. 8, the tubular connection portion 11 is covered with the shielded conductor Wd onto which a pair of shielded conductor crimping portions 12*a*, 12*a* and a pair of sheath crimping portions 12*b*, 12*b* of the outer conductor cover 6 are crimped. The tubular connection portion 11 includes a large-diameter portion 11*a* onto which the shielded conductor crimping portions 12*a*, 12*a* are to be crimped, and a small-diameter portion 11*b* onto which the sheath crimping portion 12*b*, 12*b* are to be crimped. Outer diameters of the large-diameter portion 11*a* and the small-diameter portion 11*b* of the tubular connection portion 11 are made slightly larger than an inner diameter of the shielded conductor Wd so as to allow the tubular connection portion 11 to be easily inserted into the shielded conductor Wd. In a case where the shielded conductor Wd consists of a braided wire of a plurality of elemental wires, if the inner diameter of the shielded conductor Wd is enlarged, picks of the elemental wires are frayed. However, because the outer diameter of the tubular connection portion 11 having a circle shape in cross section is made substantially equal to the inner diameter of the shielded conductor Wd consisting of a braided wire, picks of the elemental wires are not frayed, whereby uniform crimping of the shielded conductor crimping portions 12*a*, 12*a* onto the shielded conductor Wd is performed, resulting in enhanced connection reliability of the tubular connection portion 11, the shielded conductor Wd and the shielded conductor crimping portions 12*a*, 12*a*, and pull-out strength of the shielded conductor Wd.

The large-diameter portion 11*a* of the tubular connection portion 11 has a substantially perfect circle shape in cross section as shown in FIG. 9A. Owing to the large-diameter portion 11*a* having a substantially perfect circle shape in cross section, uniform compression stress is developed in the cross section during the crimping process, whereby the large-diameter portion 11*a* is not bent in its intermediate portion and shows high mechanical strength after being deformed by the crimping process. A projection portion 11*c* that projects upward is provided to a top wall of the large-diameter portion 11*a*. A fitting hole 12*d* is provided to a top wall of a crimp portion 12 of the outer conductor cover 6 as shown in FIG.

9A, and the projection portion 11*c* and the shielded conductor Wd are inserted into the fitting hole 12*d* during the crimping process (see FIG. 11A).

A fitting hole 11*d* is provided to a bottom wall of the large-diameter portion 11*a* to run through the bottom wall. Projection portions 12*c*, 12*c* of the shielded conductor crimping portions 12*a*, 12*a* of the outer conductor cover 6 shown in FIG. 9A and the shielded conductor Wd are inserted into the fitting hole 11*d* during the crimping process (see FIG. 11A). During the crimping process, tips of the projection portions 12*c*, 12*c* slightly angled inward come into contact with each other to bend the projection portions 12*c*, 12*c* inward so as to push the shielded conductor Wd into the fitting hole 11*d* of the large-diameter portion 11*a*. Accordingly, the projection portions 12*c*, 12*c* can push the shielded conductor Wd into the fitting hole 11*d* of the large-diameter portion 11*a* in a smoother manner than that described in the first preferred embodiment of the present invention in which the projection portions 8*c*, 8*c* of the shielded conductor crimping portions 8*a*, 8*a* that project inward push the shielded conductor Wd into the fitting hole 7*d* of the large-diameter portion 7*a*, the inwardly-projecting projection portions 8*c*, 8*c* holding the shielded conductor Wd to bring about a pushed-in state. As described above, the shielded conductor Wd can be smoothly guided into the fitting hole 11*d* and the tips of the projection portions 12*c*, 12*c* inwardly hold the shielded conductor Wd at the fitting hole 11*d* while preventing the shielded conductor Wd going outward, whereby allowing the shielded conductor Wd at the fitting hole 11*d* to be held without fail. At this time, the shielded conductor Wd is fixed to the large-diameter portion 11*a* by the crimping of the shielded conductor crimping portions 12*a*, 12*a*.

The small-diameter portion 11*b* of the tubular connection portion 11 has a substantially perfect circle shape in cross section as shown in FIG. 9B. Owing to the small-diameter portion 11*b* having a substantially perfect circle shape in cross section, uniform compression stress is developed in the cross section during the crimping process, whereby the small-diameter portion 11*b* is not bent in its intermediate portion and shows high mechanical strength after being deformed by the crimping process. The small-diameter portion 11*b* is covered with the shielded conductor Wd and the sheath We as shown in FIG. 8.

Further, a fitting hole 11*e* is provided to the bottom wall of the small-diameter portion 11*b* to run through the bottom wall. Projection portions 12*e*, 12*e* of the sheath crimping portions 12*b*, 12*b* of the outer conductor cover 6 shown in FIG. 9B and the shielded conductor Wd are inserted into the fitting hole 11*e* while the projection portions 12*e*, 12*e* break through the sheath We during the crimping process (see FIG. 11B). During the crimping process, the tips of the projection portions 12*e*, 12*e* slightly angled inward come into contact with each other, and the projection portions 12*e*, 12*e* are bent inward to break through the shielded conductor Wd so as to push the shielded conductor Wd into the fitting hole 11*e* of the small-diameter portion 11*b*. At this time, the shielded conductor Wd and the sheath We are fixed to the small-diameter portion 11*b* by the crimping of the shielded conductor crimping portions 12*b*, 12*b* (see FIG. 11B).

The crimp portion 12 is provided to the back side of the cover portion 6*a* of the outer conductor cover 6. The crimp portion 12 includes the shielded conductor crimping portions 12*a*, 12*a* that open downward and the sheath crimping portions 12*b*, 12*b* that open downward.

The shielded conductor crimping portions 12*a*, 12*a* extend downward from the top wall of the crimp portion 12. At the centers of the lower ends of the shielded conductor crimping portions 12*a*, 12*a*, the projection portions 12*c*, 12*c* angled slightly inward are provided. The projection portions 12*c*, 12*c* and the shielded conductor Wd are inserted into the fitting hole 11*d* of the large-diameter portion 11*a* of the outer conductor case 5 during the crimping process.

Further, the fitting hole 12*d* is provided to the top wall of the crimp portion 12 at a position corresponding to the shielded conductor crimping portions 12*a*, 12*a* to run through the top wall. The projection portion 11*c* of the large-diameter portion 11*a* of the tubular connection portion 11 and the shielded conductor Wd are inserted into the fitting hole 12*d* during the crimping process.

The sheath crimping portions 12*b*, 12*b* extend downward from the top wall of the crimp portion 12. At the centers of the lower ends of the sheath crimping portions 12*b*, 12*b*, the projection portions 12*e*, 12*e* slightly angled inward are provided. The projection portions 12*e*, 12*e* break through the sheath We when the projection portions 12*e*, 12*e* and the shielded conductor Wd are inserted into the fitting hole 11*e* of the small-diameter portion 11*b* of the outer conductor cover 5 during the crimping process. Owing to this arrangement, the shielded conductor Wd and the sheath We are fixed to the small-diameter portion 11*b* of the tubular connection portion 11.

According to the shielded connector 10 having the configuration in which the tubular connection portion 11 and the shielded conductor crimping portions 12*a*, 12*a* are provided to the outer conductor shell 4, the tubular connection portion 11 having a circle shape in cross section and arranged to be inserted into the shielded conductor Wd which is exposed by stripping off the portion of the sheath We at the end portion of the shielded twisted-pair wire W, and the shielded conductor crimping portions 12*a*, 12*a* opposed to the tubular connection portion 11 and arranged to be crimped onto the portion of the shielded conductor Wd in which the tubular connection portion 11 has been inserted. Accordingly, the shielded conductor crimping portions 12*a*, 12*a* exert compression force in normal direction to the outer surface of the tubular connection portion 11 on the shielded conductor Wd located on the tubular connection portion 11 without having an influence such as deformation of cross sections on the signal wires Wa in the shielded conductor Wd, whereby enhanced connection reliability between the shielded conductor Wd and the shielded conductor crimping portions 12*a*, 12*a* are achieved.

Further, the sheath crimping portions 12*b*, 12*b* provided to the outer conductor shell 4 are crimped onto the end portion of the sheath We into which the tubular connection portion 11 has been inserted. Accordingly, the sheath crimping portions 12*b*, 12*b* exert compression force in normal direction to the outer surface of the tubular connection portion 11 on the sheath We located on the tubular connection portion 7, whereby enhanced pull-out strength is also achieved.

Still further, the outer conductor shell 4 is comprised of two members of the outer conductor case 5 and the outer conductor cover 6, the outer conductor case 5 including the tubular connection portion 11 and the outer conductor cover 6 including the crimp portion 12. Accordingly, the number of members comprising the outer conductor shell 4 can be minimized.

In this case, the projection portion 11*c* is provided to the top wall of the large-diameter portion 11*a* of the tubular connection portion 11 at the position opposed to the shielded conductor crimping portions 12*a*, 12*a*, the fitting hole 12*d* is provided to the shielded conductor crimping portions 12*a*, 12*a* opposed to the projection portion 11*c*, and the projection portion 11*c* and the shielded conductor Wd are inserted into the fitting hole 12*d* during the crimping process. Accordingly, enhanced pull-out strength of the shielded conductor Wd as well as improved connection reliability among the tubular connection portion 11, the shielded conductor Wd and the shielded conductor crimping portions 12*a*, 12*a* are achieved.

Yet further, the fitting hole 11*d* is provided to the bottom wall of the large-diameter portion 11*a* of the tubular connection portion 11, and the projection portions 12*c*, 12*c* of the shielded conductor crimping portions 12*a*, 12*a* and the shielded conductor Wd are inserted into the fitting hole 11*d*. Accordingly, the shielded conductor crimping portions 12*a*, 12*a* can further exert compression force in tangential direction on the shielded conductor Wd located on the tubular connection portion 11, whereby enhanced pull-out strength of the shielded conductor Wd as well as improved connection reliability between the shielded conductor Wd and the shielded conductor crimping portions 12*a*, 12*a* are achieved. Further, this arrangement also prevents lifting caused by spring-back of the shielded conductor crimping portions 12*a*, 12*a* after the crimping process.

Additionally, the fitting hole 11*e* is provided to the small-diameter portion 11*b* of the tubular connection portion 11, and the projection portions 12*e*, 12*e* of the sheath crimping portions 12*b*, 12*b* and the shielded conductor Wd are inserted into the fitting hole 11*e* while the projection portions 12*e*, 12*e* are bent to break through the sheath We. Accordingly, the sheath crimping portions 12*b*, 12*b* can further exert compression force in tangential direction on the shielded conductor Wd located on the tubular connection portion 11 and the sheath We, whereby the sheath crimping portions 12*b*, 12*b* are brought into contact with the shielded conductor W, and enhanced pull-out strength of the shielded twisted-pair wire W is achieved. Further, this arrangement also prevents lifting caused by spring-back of the sheath crimping portions 12*b*, 12*b* after the crimping process.

The foregoing description of the shielded connector according to the preferred embodiments of the invention is not intended to be exhaustive or to limit the invention to the precise form disclosed, and variations may be made within the scope of the intension of the present invention. For example, although a shielded twisted-pair wire having six signal wires is used as a shielded cable in the preferred embodiments of the present invention for illustrative purpose, the present invention is also applicable to a coaxial cable having a single signal wire and the number of the signal wire is not limited. Further, either of shielded connectors of a female terminal shape or a male terminal shape may be applicable to the present invention, not to mention.

The invention claimed is:

1. A shielded connector to be connected to an end portion of a shielded cable having a signal wire, a shielded conductor arranged to cover the signal wire, and a sheath arranged to cover the shielded conductor, the shielded connector comprising:

an outer conductor shell comprising:

a tubular connection portion having a circle shape in cross section and arranged to be inserted into an end portion of the shielded conductor which is exposed by stripping off a portion of the sheath at the end portion of the shielded cable and into an end portion of the sheath;

a pair of shielded conductor crimping portions opposed to the tubular connection portion and arranged to be crimped onto the end portion of the shielded conductor into which the tubular connection portion has been inserted; and a pair of sheath crimping portions opposed to the tubular connection portion and arranged to be crimped onto the end portion of the sheath into which the tubular connection portion has been inserted, wherein an outer diameter of a portion of the tubular connection portion onto which the shielded conductor crimping portions are crimped and an outer diameter of a portion of the tubular connection portion onto which the sheath crimping portions are crimped are made substantially equal to an inner diameter of the shielded conductor, wherein the tubular connection portion has a substantially circular shape in cross section after the crimping process, and wherein the portion of the tubular connection portion onto which the shielded conductor crimping portions are crimped substantially forms a circle in cross section.

2. The shielded connector according to claim 1, wherein the outer conductor shell further comprises:

a projection portion provided to a top wall of the tubular connection portion at a position opposed to the shielded conductor crimping portions; and a fitting hole provided to the shielded conductor crimping portions opposed to the projection portion, wherein the projection portion and the shielded conductor are inserted into the fitting hole during the crimping process.

3. The shielded connector according to claim 1, wherein the outer conductor shell further comprises a fitting hole provided to a bottom wall of the tubular connection portion, and wherein lower ends of the shielded conductor crimping portions and the shielded conductor are inserted into the fitting hole, which prevents lifting caused by spring-back of the shielded conductor crimping portions after the crimping process.

4. The shielded connector according to claim 3, wherein the outer conductor shell further comprises projection portions provided to the lower ends of the shielded conductor crimping portions, and wherein the projection portions and the shielded conductor are inserted into the fitting hole provided to the bottom wall of the tubular connection portion while tips of the projection portions come into contact with each other to bend the projection portions.

5. The shielded connector according to claim 1, wherein the outer conductor shell further comprises a fitting hole provided to the bottom wall of the tubular connection portion, and wherein lower ends of the sheath crimping portions and the shielded conductor are inserted into the fitting hole while the sheath crimping portions are bent to break through the sheath, which prevents lifting caused by spring-back of the sheath crimping portions after the crimping process.

6. The shielded connector according to claim 5, wherein the outer conductor shell further comprises projection portions each provided to the lower ends of the sheath crimping portions.

* * * * *